US006786698B2

(12) United States Patent
Warner et al.

(10) Patent No.: US 6,786,698 B2
(45) Date of Patent: Sep. 7, 2004

(54) STEAM TURBINE BUCKET FLOWPATH

(75) Inventors: Craig M. Warner, Malta, NY (US); Bernard Arthur Couture, Jr., Schenectady, NY (US); John Cleland Lavash, Niskayuna, NY (US); Ronald Wayne Korzun, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/322,567

(22) Filed: Dec. 19, 2002

(65) Prior Publication Data

US 2004/0120823 A1 Jun. 24, 2004

(51) Int. Cl.[7] ..... F01D 5/22
(52) U.S. Cl. ..... 416/191; 416/193 A
(58) Field of Search ..... 416/189, 191, 416/193 A

(56) References Cited

U.S. PATENT DOCUMENTS 2,220,918 A * 11/1940 Smith ..... 416/191
3,490,852 A * 1/1970 Carlstrom et al. ..... 416/95
3,576,377 A * 4/1971 Beanland et al. ..... 416/191
4,135,857 A * 1/1979 Pannone et al. ..... 416/193 A

* cited by examiner

*Primary Examiner*—Ninh H. Nguyen
(74) *Attorney, Agent, or Firm*—Nixon & Vanderhye P.C.

(57) ABSTRACT

A turbine bucket is disclosed which includes a dovetail for mounting the bucket within the turbine, a parallelogram-shaped platform connected to the dovetail, a parallelogram-shaped shroud, and an airfoil connected between the platform and the shroud. The platform includes an inner flowpath surface at which a first end of the airfoil intersects with the platform the inner flowpath surface being parallelogram-shaped and formed from a first inclined plane and a second inclined plane that meet at a first common boundary and form a first ridge or valley, boundary bisecting the inner flowpath surface, the shroud including an outer flowpath surface at which the second end of the airfoil intersects the shroud, the outer flowpath surface being parallelogram-shaped and formed from a third inclined plane and a fourth inclined plane that meet at a second common boundary and form a second ridge or valley, second common boundary bisecting the outer flowpath surface.

40 Claims, 4 Drawing Sheets

STEAM TURBINE BUCKET FLOWPATH

The present invention relates to steam turbine buckets, and in particular, to an improved steam turbine bucket flowpath design that eliminates flowpath steps between adjacent buckets.

BACKGROUND OF THE INVENTION

In a steam turbine (not shown), the turbine buckets are typically installed adjacent to one another circumferentially around a turbine wheel (also not shown). FIG. 1*a* shows a stage 10 that includes a plurality of prior art buckets 12 as they would be mounted adjacent to one another around a portion of a turbine wheel. Each bucket 12 includes a dovetail 14 for mounting the buckets around the turbine wheel. To the outside of each dovetail 14 is a parallelogram-shaped platform 16 from which protrudes an airfoil 18. Each airfoil 18 includes a pressure side 20 that is partially concave in shape and a suction side 22 that is convex in shape. To the outside of each airfoil 18 is a parallelogram-shaped shroud 24.

Each bucket 12's platform 16 includes a flat inner flowpath surface 26 at which one end 28 of the corresponding airfoil 18 intersects with platform 16. Similarly, each bucket 12's shroud 24 includes a second flat outer flowpath surface 30 (FIG. 1*c*) at which the other end 32 of the corresponding airfoil 18 intersects with shroud 24.

Adjacent buckets, such as buckets 12*a* and 12*b* shown in FIG. 1*b*, form an inner flowpath 34, which is established by adjacent inner flowpath surfaces 26*a* and 26*b* of adjacent platforms 16*a* and 16*b*, by way of example. Adjacent buckets also form an outer flowpath 36, which is established by adjacent outer flowpath surfaces 30*a* and 30*b* of adjacent shrouds 24*a* and 24*b* of buckets 12*a* and 12*b*, again by way of example.

When buckets 12 are installed circumferentially around a turbine wheel, their airfoils 18 are each skewed with respect to the centerline (not shown) of the turbine. As they follow the circumference of the turbine wheel, airfoils 18 are staggered with respect to the centerline of the turbine. Each bucket 12's platform 16 is then angled with respect to the centerline of the turbine to follow the stagger angle of the airfoils 18 around the turbine wheel. As such, as shown in FIG. 1*b*, flowpath steps 38 in flowpath 34 are created between the platforms 16 of adjacent buckets, such as platforms 16*a* and 16*b* of buckets 12*a* and 12*b*, shown by way of example in FIG. 1*b*.

Similarly, each bucket 12's shroud 24 is angled with respect to the centerline of the turbine to, again, follow the stagger angle of the airfoils 18 around the turbine wheel. Here again, as shown in FIG. 1*c*, flowpath steps 40 are created in an outer flowpath 36 between the shrouds 24 of adjacent buckets, such as shrouds 24*a* and 24*b* of buckets 12*a* and 12*b*, again by way of example.

FIGS. 1*b* and 1*c* depict typical distinct steps in the flowpaths of prior art steam turbine buckets. These circumferential steps in a turbine's flowpath reduce the aerodynamic performance of the turbine. Advantageously, however, these prior art buckets can be manufactured using 3-axis milling machines that are not too expensive to buy or operate. In addition, manufacturing shops typically have 3-axis machines.

It should be noted that steam turbine buckets without flowpath steps can be made. Such buckets have inner and outer flowpath surfaces that are "surfaces of revolution" about the centerline of the turbine. However, these buckets can be made only with 5-axis milling machines that are much more expensive to buy and operate than 3-axis machines. Thus, it would be very desirable for a manufacturer of steam turbines to have the ability to make buckets with 3-axis milling machines and that do not form flowpath steps when mounted together around a turbine wheel.

BRIEF DESCRIPTION OF THE INVENTION

In an exemplary embodiment of the invention, a turbine bucket comprises a platform, a shroud, and an airfoil connected between the platform and the shroud, the platform including an inner flowpath surface at which the airfoil is connected to the platform, the inner flowpath surface being formed from a first inclined plane and a second inclined plane that meet at a first common boundary and form a first ridge or valley, the shroud including an outer flowpath surface at which the airfoil is connected to the shroud, the outer flowpath surface being formed from a third inclined plane and a inclined plane that meet at a second common boundary and form a second ridge or valley.

In another exemplary embodiment of the invention, a turbine bucket comprises a dovetail for mounting the bucket within the turbine, a platform connected to the dovetail, a shroud, and an airfoil connected between the platform and the shroud, the platform including an inner flowpath surface at which the airfoil is connected to the platform, the inner flowpath surface being formed from a first inclined plane and a second inclined plane that meet at a first common boundary and form a first ridge or valley, the shroud including an outer flowpath surface at which the airfoil is connected to the shroud, the outer flowpath surface being formed from a third inclined plane and a inclined plane that meet at a second common boundary and form a second ridge or valley, an inner flowpath being formed without steps by inner flowpath surface when it is positioned adjacent to a second inner flowpath surface of a second platform of a second bucket positioned adjacent to the bucket, and an outer flowpath being formed without steps by outer flowpath surface when it is positioned adjacent to a second outer flowpath surface adjacent of a second shroud of the second bucket positioned adjacent to the bucket.

In yet another exemplary embodiment of the invention, a turbine bucket comprises a dovetail for mounting the bucket within the turbine, a parallelogram-shaped platform connected to the dovetail, a parallelogram-shaped shroud, and an airfoil connected at a first end to the platform and at a second end to the shroud, the platform including an inner flowpath surface at which the first end of the airfoil intersects the platform, the inner flowpath surface being parallelogram-shaped and formed from a first triangular-shaped inclined plane and a second triangular-shaped inclined plane that meet at a first common boundary and form a first ridge or valley, the first common boundary bisecting the inner flowpath surface, the shroud including an outer flowpath surface at which the second end of the airfoil intersects the shroud, the outer flowpath surface being parallelogram-shaped and formed from a third triangular-shaped inclined plane and a fourth triangular-shaped inclined plane that meet at a second common boundary and form a second ridge or valley, the second common boundary bisecting the outer flowpath surface.

In a further exemplary embodiment of the invention, a stage of turbine buckets includes at least two buckets, each bucket comprises a dovetail for mounting the bucket within the turbine, a parallelogram-shaped platform connected to the dovetail, a parallelogram-shaped shroud, and an airfoil connected at a first end to the platform and at a second end to the shroud, the platform including an inner flowpath surface at which the first end of the airfoil intersects the platform, the inner flowpath surface being parallelogram-shaped and formed from a first triangular-shaped inclined plane and a second triangular-shaped inclined plane that meet at a first common boundary and form a first ridge or valley, the first common boundary bisecting the inner flowpath surface, the shroud including an outer flowpath surface at which the second end of the airfoil intersects the shroud, the outer flowpath surface being parallelogram-shaped and formed from a third triangular-shaped inclined plane and a fourth triangular-shaped inclined plane that meet at a second common boundary and form a second ridge or valley, the second common boundary bisecting the outer flowpath surface, an inner flowpath being formed without steps by adjacent inner flowpath surfaces when two of the plurality of platforms are positioned adjacent to one another, and an outer flowpath being formed without steps by adjacent outer flowpath surfaces when the two platforms are positioned adjacent to one another.

In yet a further exemplary embodiment of the invention, a turbine bucket flowpath comprises a first flowpath surface formed on a first platform or shroud of a first bucket, the flowpath surface being formed from a first inclined plane and a second inclined plane that meet at a first common boundary and form a first ridge or valley, the first common boundary bisecting the flowpath surface, and a second flowpath surface formed on a second platform or shroud of a second bucket, the second flowpath surface being formed from a third inclined plane and a fourth inclined plane that meet at a second common boundary and form a second ridge or valley, the second common boundary bisecting the second flowpath surface, the flowpath being formed by the second inclined plane of the bucket and the third inclined plane of the second bucket adjacent to the bucket, the second and third planes sharing a common flush edge at the interface between them.

In still a further exemplary embodiment of the invention, a inner turbine bucket flowpath comprises a first inner flowpath surface formed on a first parallelogram-shaped platform of a first bucket, the inner flowpath surface being formed from a first triangular-shaped inclined plane and a second triangular-shaped inclined plane that meet at a first common boundary and form a first ridge or valley, the first common boundary bisecting the inner flowpath surface, and a second inner flowpath surface formed on a second parallelogram-shaped platform of a second bucket, the inner flowpath surface being formed from a third triangular-shaped inclined plane and a fourth triangular-shaped inclined plane that meet and form a second ridge, which bisects the inner flowpath surface, the inner flowpath being formed by the second triangular-shaped inclined plane of the bucket and the first triangular-shaped inclined plane of the second bucket adjacent to the bucket, the first and second planes and sharing a common flush edge at the interface between them.

In still another exemplary embodiment of the invention, an outer turbine bucket flowpath comprises a first outer flowpath surface formed on a first parallelogram-shaped shroud of a first bucket, the outer flowpath surface being formed from a first triangular-shaped inclined plane and a second triangular-shaped inclined plane that meet at a first common boundary and form a first ridge or valley, the first common boundary bisecting the inner flowpath surface, and a second outer flowpath surface formed on a second parallelogram-shaped shroud of a second bucket, the outer flowpath surface being formed from a third triangular-shaped inclined plane and a fourth triangular-shaped inclined plane that meet at a second common boundary and form a second ridge or valley, the second common boundary bisecting the inner flowpath surface, the outer flowpath being formed by the second triangular-shaped inclined plane of the bucket and the third triangular-shaped inclined plane of the second bucket adjacent to the bucket, the second and third planes and sharing a common flush edge at the interface between them.

DETAILED DESCRIPTION OF THE INVENTION

Figure 1A:
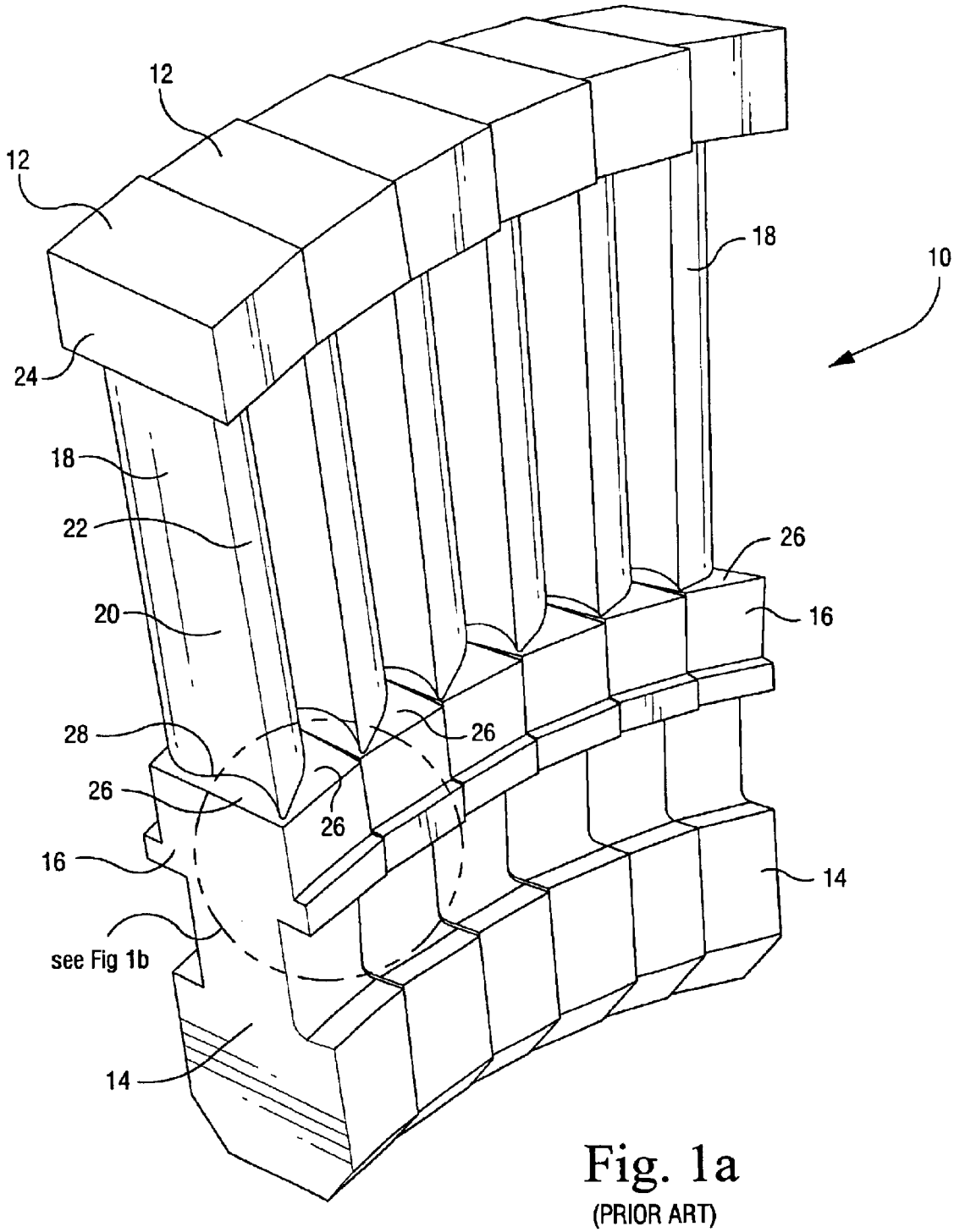
Fig. 1a (PRIOR ART)
FIG. 1*a* is a perspective view of a stage of prior art buckets mounted adjacent to one another around a portion of a turbine wheel.
Figure 1B:
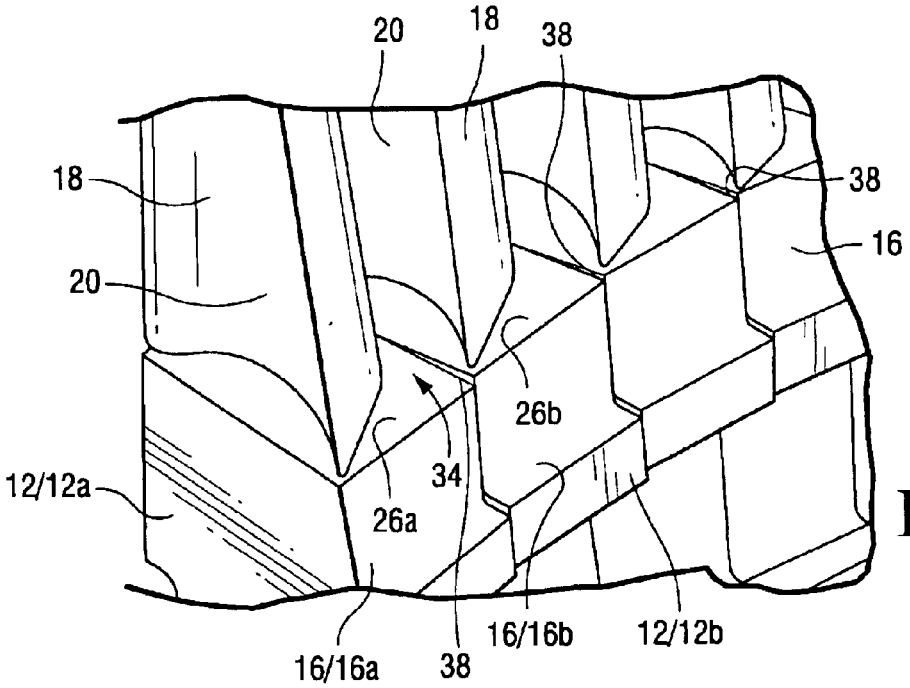
Fig. 1b (PRIOR ART)
FIG. 1*b* is a partially enlarged perspective view of the inner portion of the stage of prior art buckets shown in FIG. 1*a*.
Figure 1C:
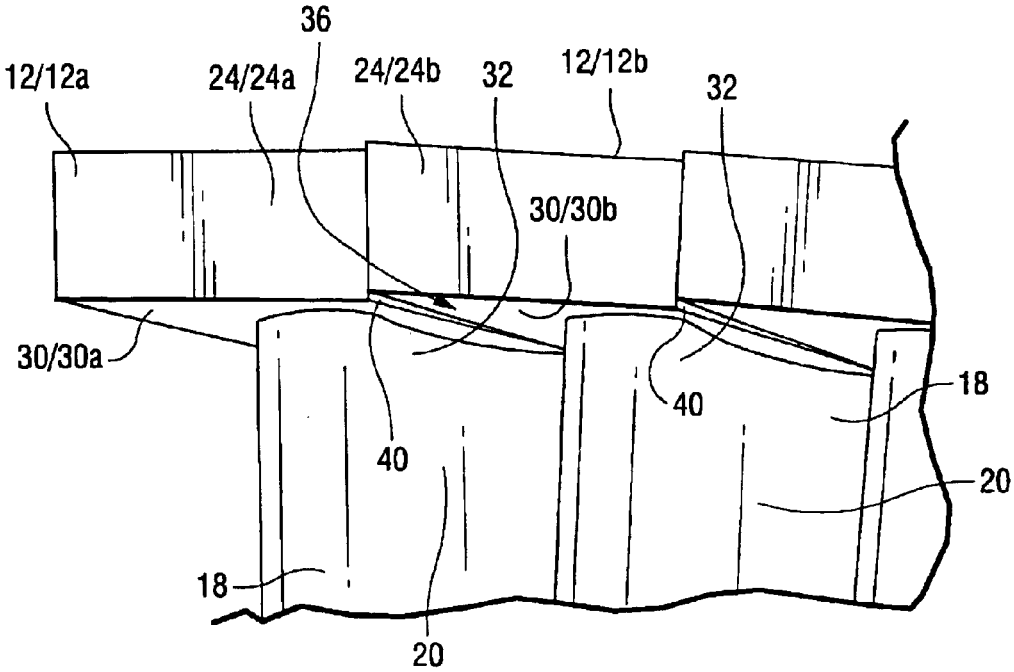
Fig. 1c (PRIOR ART)
FIG. 1*c* is a partially enlarged perspective view of the outer portion of the stage of prior art buckets shown in FIG. 1*a*.
Figure 2A:
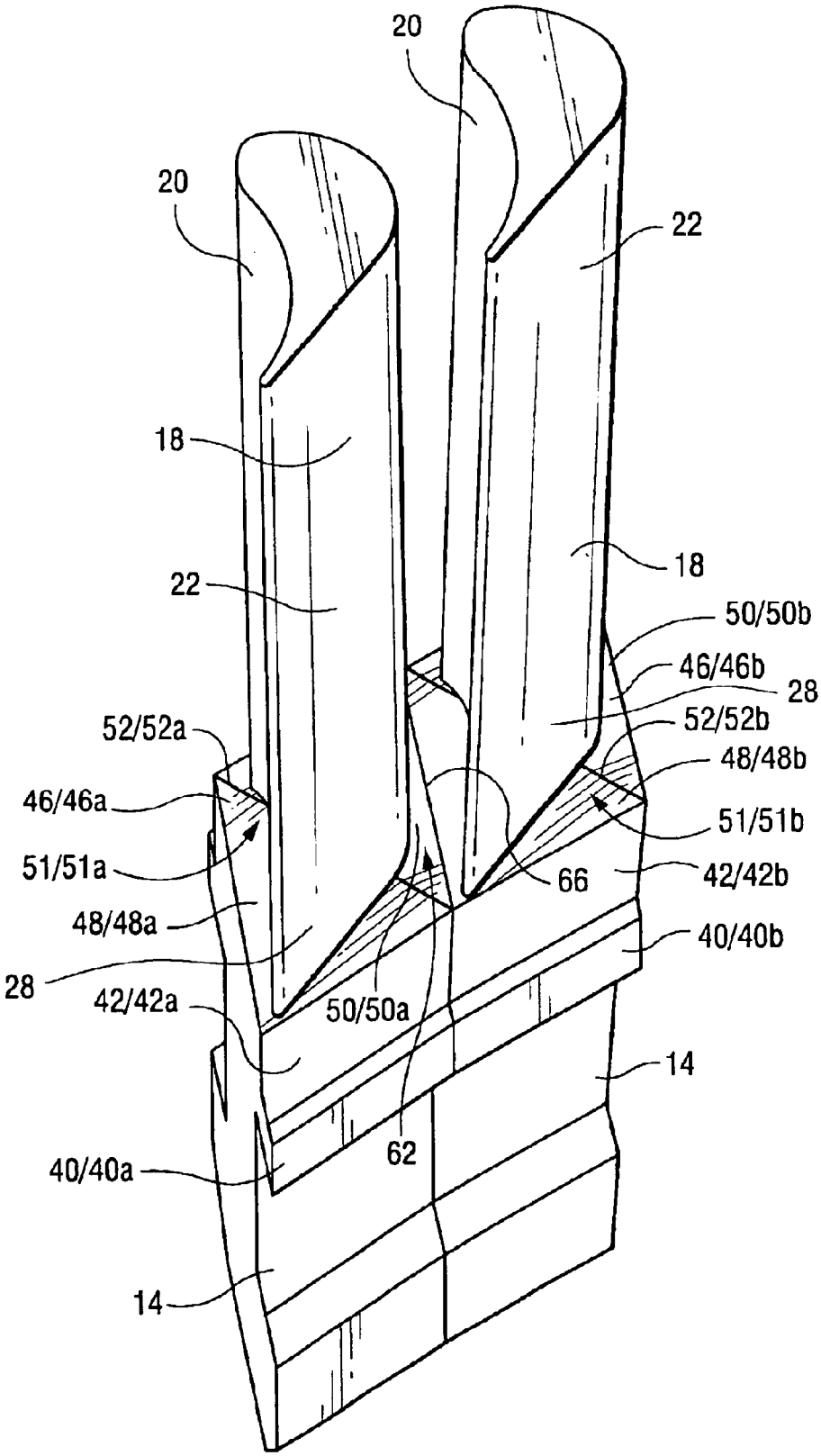
FIG. 2*a* is a partial perspective view of the inner portion of two buckets with an inner flowpath surface made according to the present invention.
Figure 2B:
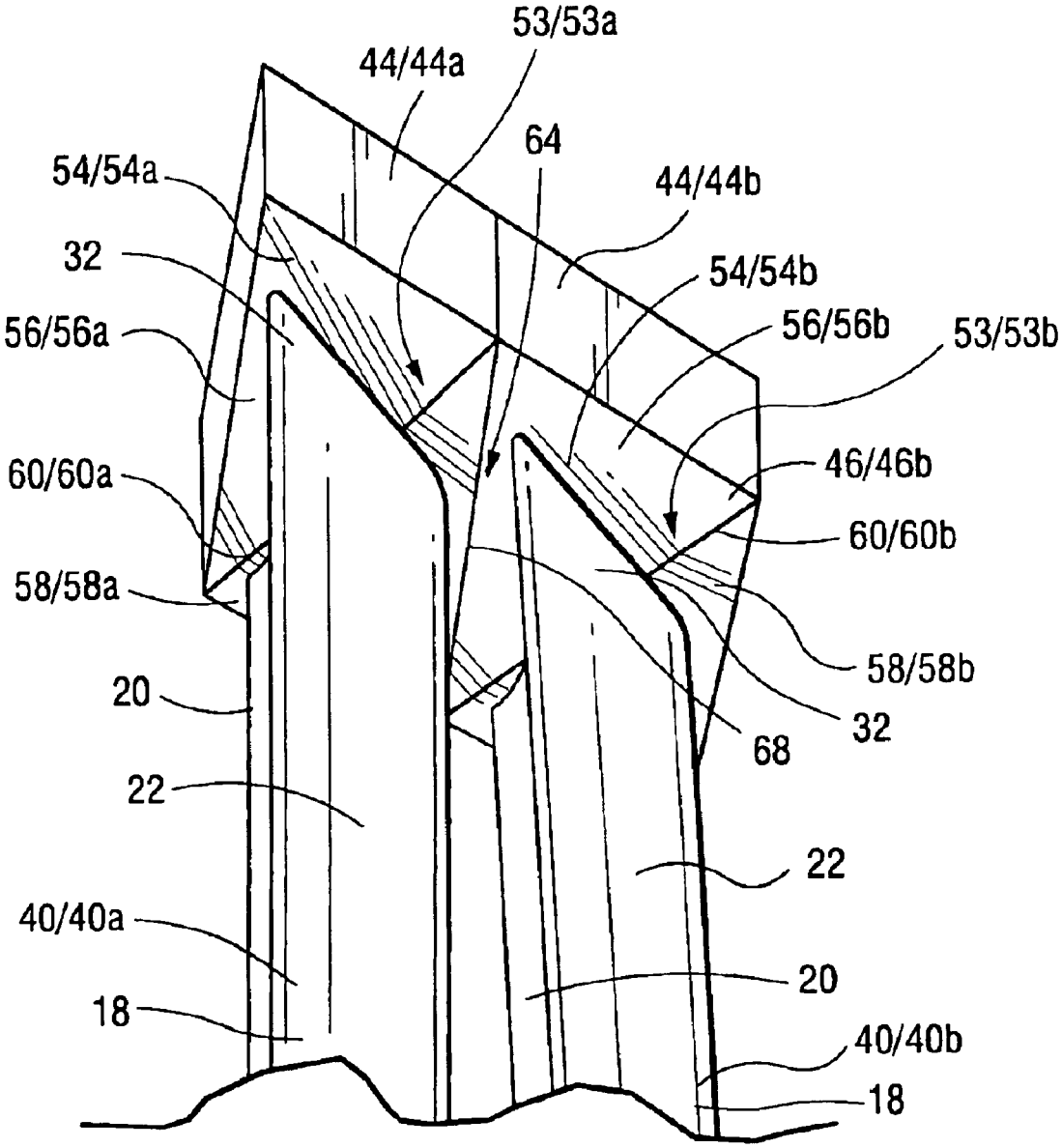
FIG. 2*b* is a partial perspective view of the outer lower portion of two buckets with an outer flowpath surface made according to the present invention.

FIGS. 2*a* and 2*b* each show a portion of two buckets 40 made according to the present invention. The buckets 40 are again oriented as they would be when mounted adjacent to one another around a turbine wheel. Each bucket 40 again includes a dovetail 14 like the dovetail 14 of the prior art bucket 12 for mounting the buckets 40 around the turbine wheel. To the outside of each dovetail 14 is a parallelogram-shaped platform 42 from which protrudes an airfoil 18 like the airfoil 18 of the prior art bucket 12. Each airfoil 18 again includes a pressure side 20 and a suction side 22 like the prior art airfoil 18. As shown in FIG. 2*b*, to the outside of each airfoil 18 is a parallelogram-shaped shroud 44.

Each bucket 40's platform 42 includes an inner flowpath surface 46 at which one end 28 of the corresponding airfoil 18 intersects with platform 42. Surface 46 is a parallelogram-shaped surface that is formed from two triangular-shaped inclined planes 48 and 50 that meet at a common boundary 52, which bisects surface 46. Inclined planes 48 and 50 form either a ridge 51 or a valley 51. The angle of inclination between planes 48 and 50 is a function of the airfoil stagger angle.

Similarly, each bucket 40's shroud 44 includes an outer flowpath surface 54 at which the other end 32 of the corresponding airfoil 18 intersects with shroud 44. Like surface 46, surface 54 is also a parallelogram-shaped surface that is also formed from two triangular-shaped inclined planes 56 and 58 that meet at a common boundary 60, which bisects surface 54. Here again, inclined planes 56 and 58 form a second ridge 53 or valley 53, the angle of inclination between planes 56 and 58 is a function of the airfoil stagger angle.

Adjacent buckets, such as buckets 40*a* and 40*b* shown in FIG. 2*a*, form an inner flowpath 62, which is established by adjacent surfaces 46*a* and 46*b* of adjacent platforms 42*a* and 42*b*. Adjacent buckets 40*a* and 40*b* also form an outer flowpath 64, which is established by adjacent surfaces 54*a* and 54*b* of adjacent shrouds 44*a* and 44*b*.

The parallelogram shape of the inner flowpath surface 46*a* is divided into two triangular planes 48*a* and 50*a* that meet at a common boundary 52*a* and form a ridge 51*a* or a valley 51*a*. Similarly, the parallelogram shape of the inner flowpath surface 46*b* is also divided into two triangular planes 48*b* and 50*b* that meet at a common boundary 52*b* and form a ridge 51*b* or a valley 51*b*. The improved steam turbine bucket inside flowpath 62 consists of the two planes 50*a* and 48*b* sharing a common flush edge 66 at the interface between the two adjacent buckets 40*a* and 40*b*. This common flush edge 66 eliminates the flowpath steps 38 common in prior art buckets 12.

The parallelogram shape of the outer flowpath surface 54*a* is also divided into two triangular planes 56*a* and 58*a* that meet at a common boundary 60*a* and form a ridge 53*a* or a valley 53*a*. Similarly, the parallelogram shape of the outer flowpath surface 54*b* is also divided into two triangular planes 56*b* and 58*b* that meet at a common boundary 60*b* and form a ridge 53*b* or a valley 53*b*. The improved steam turbine bucket outer flowpath 64 consists of the two planes 58*a* and 56*b* sharing a common flush edge 68 at the interface between the two adjacent buckets 40*a* and 40*b*. This common flush edge 68 again eliminates the flowpath steps 38 common in prior art buckets 12.

One advantage of the bucket flowpath surface configuration used in the present invention is the potential of machining such surfaces without the use of 5-axis milling machines, thus making the part manufacturing more robust and cheaper to make.

The improved bucket flowpath surface configuration of the present invention could be used on reaction turbine buckets, as well as all other skewed and integral tip shrouded bucket designs.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket comprising:

a platform;

a shroud; and an airfoil connected between the platform and the shroud;

the platform including an inner flowpath surface at which the airfoil is connected to the platform, the inner flowpath surface being formed from a first inclined plane and a second inclined plane that meet at a first common boundary, wherein an inner flowpath without steps is formed between the inner flowpath surface and a second inner flowpath surface of a second platform of a second bucket of substantially the same construction as the bucket when the bucket is positioned adjacent to the second bucket;

the shroud including an outer flowpath surface at which the airfoil is connected to the shroud, the outer flowpath surface being formed from a third inclined plane and a fourth inclined plane that meet at a second common boundary, wherein an outer flowpath without steps is formed between the outer flowpath surface and a second outer flowpath surface of a second shroud of the second bucket when the bucket is positioned adjacent to the second bucket.

2. A turbine bucket as recited in claim 1, wherein the inner flowpath surface and the outer flowpath surface are each parallelogram-shaped.

3. A turbine bucket as recited in claim 1, wherein the first, second, third, and fourth inclined planes are each triangular-shaped.

4. A turbine bucket as recited in claim 1, wherein the first inclined plane and the second inclined plane meet at the first common boundary and form a first ridge.

5. A turbine bucket as recited in claim 1, wherein the first inclined plane and the second inclined plane meet at the first common boundary and form a first valley.

6. A turbine bucket as recited in claim 1, wherein the third inclined plane and the fourth inclined plane meet at the second common boundary and form a second ridge.

7. A turbine bucket as recited in claim 1, wherein the third inclined plane and the fourth inclined plane meet at the second common boundary and form a second valley.

8. A turbine bucket comprising:

a dovetail for mounting the bucket within the turbine;

a platform connected to the dovetail;

a shroud; and an airfoil connected between the platform and the shroud;

the platform including an inner flowpath surface at which the airfoil is connected to the platform, the inner flowpath surface being formed from a first inclined plane and a second inclined plane that meet at a first common boundary;

the shroud including an outer flowpath surface at which the airfoil is connected to the shroud, the outer flowpath surface being formed from a third inclined plane and a fourth inclined plane that meet at a second common boundary, wherein an inner flowpath is formed without steps by the inner flowpath surface when it is positioned adjacent to a second inner flowpath surface of a second platform of a second bucket positioned adjacent to the bucket; and wherein an outer flowpath is formed without steps by the outer flowpath surface when it is positioned adjacent to a second outer flowpath surface adjacent of a second shroud of the second bucket positioned adjacent to the bucket.

9. The turbine bucket as recited in claim 8, wherein the inner flowpath surface and the outer flowpath surface are each parallelogram-shaped.

10. The turbine bucket as recited in claim 8, wherein the first, second, third, and fourth inclined planes are each triangular-shaped.

11. The turbine bucket as recited in claim 10, wherein the inner flowpath is formed by the second triangular-shaped inclined plane of the bucket and a fifth triangular-shaped inclined plane of the second bucket adjacent to the bucket, the second and fifth planes and sharing a first common flush edge at the interface between them, and wherein the outer flowpath is formed by the fourth triangular-shaped inclined plane of the bucket and a sixth triangular-shaped inclined plane of the second bucket, the fourth and sixth planes and sharing a second common flush edge (at the interface between them.

12. A turbine bucket as recited in claim 8, wherein the first inclined plane and the second inclined plane meet at the first common boundary and form a first ridge.

13. A turbine bucket as recited in claim 8, wherein the first inclined plane and the second inclined plane meet at the first common boundary and form a first valley.

14. A turbine bucket as recited in claim 8, wherein the third inclined plane and the fourth inclined plane meet at the second common boundary and form a second ridge.

15. A turbine bucket as recited in claim 8, wherein the third inclined plane and the fourth inclined plane meet at the second common boundary and form a second valley.

16. A turbine bucket comprising:

a dovetail for mounting the bucket within the turbine;

a parallelogram-shaped platform connected to the dovetail;

a parallelogram-shaped shroud; and an airfoil connected at a first end to the platform and at a second end to the shroud;

the platform including an inner flowpath surface at which the first end of the airfoil intersects with the platform, the inner flowpath surface being parallelogram-shaped and formed from a first triangular-shaped inclined plane and a second triangular-shaped inclined plane that meet at a first common boundary, which bisects the inner flowpath surface, wherein an inner flowpath without steps is formed between the inner flowpath surface and a second inner flowpath surface of a second platform of a second bucket of substantially the same construction as the bucket when the bucket is positioned adjacent to the second bucket;

the shroud including an outer flowpath surface at which the second end of the airfoil intersects with the shroud, the outer flowpath surface being parallelogram-shaped and formed from a third triangular-shaped inclined plane and a fourth triangular-shaped inclined plane that meet at a second common boundary, which bisects outer flowpath surface, wherein an outer flowpath without steps is formed between the outer flowpath surface and a second outer flowpath surface of a second shroud of the second bucket when the bucket is positioned adjacent to the second bucket.

17. The turbine bucket as recited in claim 16, wherein an inner flowpath is formed by the first triangular-shaped inclined plane of the bucket and a fifth triangular-shaped inclined plane of a second bucket adjacent to the bucket, the first and fifth planes sharing a first common flush edge at the interface between them, and wherein an outer flowpath is formed by the third triangular-shaped inclined plane of the bucket and a sixth triangular-shaped inclined plane of the second bucket, the third and sixth planes sharing a second common flush edge at the interface between them.

18. A turbine bucket as recited in claim 16, wherein the first inclined plane and the second inclined plane meet at the first common boundary and form a first ridge.

19. A turbine bucket as recited in claim 16, wherein the first inclined plane and the second inclined plane meet at the first common boundary and form a first valley.

20. A turbine bucket as recited in claim 16, wherein the third inclined plane and the fourth inclined plane meet at the second common boundary and form a second ridge.

21. A turbine bucket as recited in claim 16, wherein the third inclined plane and the fourth inclined plane meet at the second common boundary and form a second valley.

22. A stage of turbine buckets including at least two buckets, each bucket comprising:

a dovetail for mounting the bucket within the turbine;

a parallelogram-shaped platform connected to the dovetail;

a parallelogram-shaped shroud; and an airfoil connected at a first end to the platform and at a second end to the shroud;

the platform including an inner flowpath surface at which the first end of the airfoil intersects with the platform, the inner flowpath surface being parallelogram-shaped and formed from a first triangular-shaped inclined plane and a second triangular-shaped inclined plane that meet at a first common boundary, which bisects the inner flowpath surface;

the shroud including an outer flowpath surface at which the second end of the airfoil intersects with the shroud, the outer flowpath surface being parallelogram-shaped and formed from a third triangular-shaped inclined plane and a fourth triangular-shaped inclined plane that meet at a second common boundary, which bisects the outer flowpath surface;

wherein an inner flowpath is formed without steps by adjacent inner flowpath surfaces when two of the plurality of platforms are positioned adjacent to one another; and wherein an outer flowpath is formed without steps by adjacent outer flowpath surfaces when the two platforms are positioned adjacent to one another.

23. The plurality of turbine buckets of claim 22, wherein the inner flowpath is formed by the second triangular-shaped inclined plane of a first bucket and a fifth triangular-shaped inclined plane of a second bucket adjacent to the first bucket, the second and fifth planes sharing a common flush edge at the interface between the second and fifth planes, and wherein the outer flowpath is formed by the fourth triangular-shaped inclined plane of the first bucket and a sixth triangular-shaped inclined plane of the second bucket, the fourth and sixth planes sharing a common flush edge at the interface between the fourth and sixth planes.

24. A turbine bucket as recited in claim 22, wherein the first inclined plane and the second inclined plane meet at the first common boundary and form a first ridge.

25. A turbine bucket as recited in claim 22, wherein the first inclined plane and the second inclined plane meet at the first common boundary and form a first valley.

26. A turbine bucket as recited in claim 22, wherein the third inclined plane and the fourth inclined plane meet at the second common boundary and form a second ridge.

27. A turbine bucket as recited in claim 22, wherein the third inclined plane and the fourth inclined plane meet at the second common boundary and form a second valley.

28. A turbine bucket flowpath comprising:

a first flowpath surface formed on one of a first platform or shroud of a first bucket, the flowpath surface being formed from a first inclined plane and a second inclined plane that meet at a first common boundary which bisects the flowpath surface; and a second flowpath surface formed on a corresponding one of a second platform or shroud of a second bucket the second flowpath surface being formed from a third inclined plane and a fourth inclined plane that meet at a second common boundary, which bisects the second flowpath surface;

the flowpath being formed by the second inclined plane of the bucket and the third inclined plane of the second bucket adjacent to the bucket, the second and third planes sharing a common flush edge at the interface between them.

29. The turbine bucket flowpath as recited in claim 28, wherein the first flowpath surface and the second flowpath surface are each parallelogram-shaped.

30. The turbine bucket flowpath as recited in claim 28, wherein the first, second, third, and fourth inclined planes are each triangular-shaped.

31. A turbine bucket flowpath as recited in claim 28, wherein each first inclined plane and each second inclined plane meet at the first common boundary and form a first ridge.

32. A turbine bucket flowpath as recited in claim 28, wherein the first inclined plane and the second inclined plane meet at the first common boundary and form a first valley.

33. A turbine bucket as recited in claim 28, wherein the third inclined plane and the fourth inclined plane meet at the second common boundary and form a second ridge.

34. A turbine bucket flowpath as recited in claim 28, wherein the third inclined plane and the fourth inclined plane meet at the second common boundary and form a second valley.

35. An inner turbine bucket flowpath comprising:

a first inner flowpath surface formed on a first parallelogram-shaped platform of a first bucket, the inner flowpath surface being formed from a first triangular-shaped inclined plane and a second triangular-shaped inclined plane that meet at a first common boundary, which bisects the inner flowpath surface; and a second inner flowpath surface formed on a second parallelogram-shaped platform of a second bucket, the inner flowpath surface being formed from a third triangular-shaped inclined plane and a fourth triangular-shaped inclined plane that meet at a second common boundary, which bisects the inner flowpath surface;

the inner flowpath being formed by the second triangular-shaped inclined plane of the bucket and the third triangular-shaped inclined plane of the second bucket adjacent to the first bucket, the second and third planes and sharing a common flush edge at the interface between them.

36. A turbine bucket flowpath as recited in claim 35, wherein each first and third inclined plane and each second and fourth inclined plane meet, respectively, at the first and second common boundaries and form first and second ridges.

37. A turbine bucket flowpath as recited in claim 35, wherein the first and third inclined plane and the second and fourth inclined plane meet, respectively, at the first common boundary and form first and second valleys.

38. A turbine bucket as recited in claim 35, wherein the first and third inclined plane and the second and fourth inclined plane meet, respectively, at the second common boundary and form first and second ridges.

39. A turbine bucket as recited in claim 35, wherein the first and third inclined plane and the second and fourth inclined plane meet, respectively, at the second common boundary and form first and second valleys.

40. An outer turbine bucket flowpath comprising:

a first outer flowpath surface formed on a first parallelogram-shaped shroud of a first bucket, the outer flowpath surface being formed from a first triangular-shaped inclined plane and a second triangular-shaped inclined plane that meet and form a first ridge, which bisects the inner flowpath surface; and a second outer flowpath surface formed on a second parallelogram-shaped shroud of a second bucket, the outer flowpath surface being formed from a third triangular-shaped inclined plane and a fourth triangular-shaped inclined plane that meet and form a second ridge, which bisects the inner flowpath surface;

the outer flowpath being formed by the second triangular-shaped inclined plane of the bucket and the third triangular-shaped inclined plane of the second bucket adjacent to the bucket, the second and third planes and sharing a common flush edge at the interface between them.

* * * * *